United States Patent [19]

Zucker

[11] Patent Number: 4,763,110

[45] Date of Patent: Aug. 9, 1988

[54] WINDOW ALARM SYSTEM

[76] Inventor: Frank Zucker, 501 Anita St., Space 46, Chula Vista, Calif. 92011

[21] Appl. No.: 64,516

[22] Filed: Jun. 22, 1987

[51] Int. Cl.[4] ..... G08B 13/10

[52] U.S. Cl. ..... 340/541; 200/61.93; 340/666

[58] Field of Search ..... 340/541, 565, 666; 200/61.93, 52 R, 85 R, 86 R

[56] References Cited

U.S. PATENT DOCUMENTS

| | | | |
|---|---|---|---|
| 1,246,433 | 11/1917 | Kellogg | 340/541 X |
| 1,832,905 | 11/1931 | Jacobson | 340/565 X |
| 2,683,784 | 7/1954 | Rector | 340/541 X |
| 2,780,693 | 2/1957 | McClellan | 340/565 X |
| 3,991,415 | 11/1976 | Baar, Sr. | 340/541 |
| 4,245,219 | 1/1981 | Dempsey et al. | 340/541 X |

FOREIGN PATENT DOCUMENTS 3419526 11/1985 Fed. Rep. of Germany ..... 340/545

*Primary Examiner*—Stewart J. Levy
*Assistant Examiner*—Joseph W. Roskos
*Attorney, Agent, or Firm*—Charles C. Logan, II

[57] ABSTRACT

A self contained portable window alarm system that is placed on the interior surface of a window sill in a home. The system has a pressure actuated switch assembly that is in series with a battery and a siren alarm assembly. The pressure actuated electrical switch assembly appears as a pair of flat elongated strips that extend across the width of the window sill. When anyone attempts to enter through the window opening, the slightest pressure of their weight will close the electrical switch causing the siren alarm to set off a 110 decibel signal. The battery and siren alarm assembly are mounted within a housing that is rigidly attached to the pressure actuated electrical switch assembly. There are no external wires visible to the naked eye.

3 Claims, 1 Drawing Sheet

WINDOW ALARM SYSTEM

BACKGROUND OF THE INVENTION

The invention relates to an alarm system and more specifically to a window alarm system to deter unwanted intruders from climbing through the window of a house.

Today one of the most annoying problems people have is the fear and reality of intruders entering their home or apartment through one of their windows. Many alarm systems have been designed to combat this problem. Some utilize a wire tape that is glued on to the window panes and which will actuate an alarm signal if the glass of the window is broken. Other more sophisticated systems utilize noise sensors that will actuate an alarm signal. Very sophisticated systems utilize photoelectric cells to detect a person moving past the projected beam.

The more sophisticated the alarm system, generally the more expensive it is. Many people can not afford to have a luxurious total alarm system installed in their home.

It is an object of the invention to provide a novel window alarm system that is portable and has its own self contained source of electrical power.

It is also an object of the invention to provide a novel window alarm system that can be installed by practically anyone.

It is another object of the invention to provide a novel window alarm system that is economical to manufacture and market.

It is an additional object of the invention to provide a novel window alarm system that is actuated by the slightest pressure of an intruder trying to enter the window.

It is a further object of the invention to provide a novel window alarm system that does not have any exposed electrical wiring that can be easily severed.

SUMMARY OF THE INVENTION

Applicant's novel window alarm system has been designed to be portable and also to have its own self contained electrical power source. It is operated on battery power and it utilizes a minimal amount of electrical current for actuation of the siren alarm assembly.

The basic components of the system are the battery, the siren alarm assembly, and the pressure actuated electrical switch assembly. The siren alarm assembly and battery are mounted within a housing that is structurally attached to the pressure actuated electrical switch assembly. There are no exposed electrical wires to the system.

The pressure actuated electrical switch assembly is formed from a pair of elongated strip members whose length will generally be the width of the window sill. Where one window panel slides laterally with respect to a fixed panel the length of the elongated strips would only have to be as long as the width of one of the panels. These strips are vertically separated from each other and have a spacer that connects one of their lateral edges to function as a hinge member. The opposite lateral edge of the strip members has elongated metal strips positioned between the two respective members and these maintain a predetermined separation as long as there is no external pressure applied to the top strip member. These two metal strips function as terminals of the switch assembly and they are respectively connected to the battery and also the siren alarm assembly.

If an intruder attempts to enter the window opening, only a minimal amount of pressure on the top surface of the switch assembly will close the electrical circuit and set off a 110 decibel signal from the siren alarm assembly. The amount of pressure to actuate the switch assembly can be varied according to the resiliency of the elongated strip members. Generally less than a half pound of weight will set off the alarm.

DESCRIPTION OF THE PREFERRED EMBODIMENT

Figure 1:
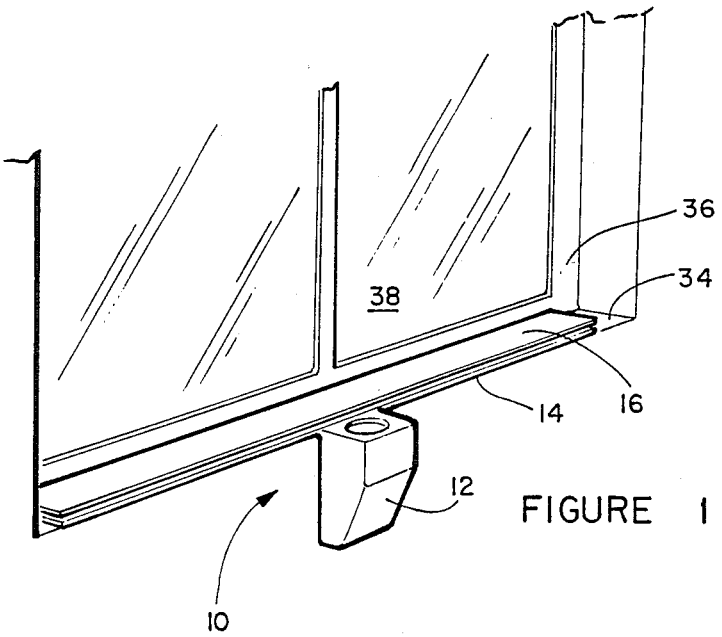
FIG. 1 is a perspective view illustrating applicant's novel window alarm system installed on a window sill.
Figure 2:
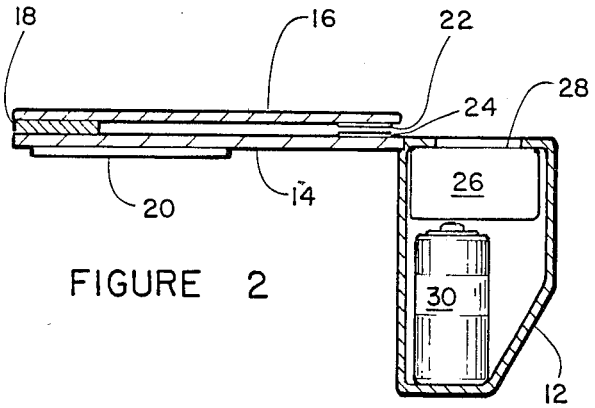
FIG. 2 is a vertical cross section of applicant's novel window alarm system.
Figure 3:
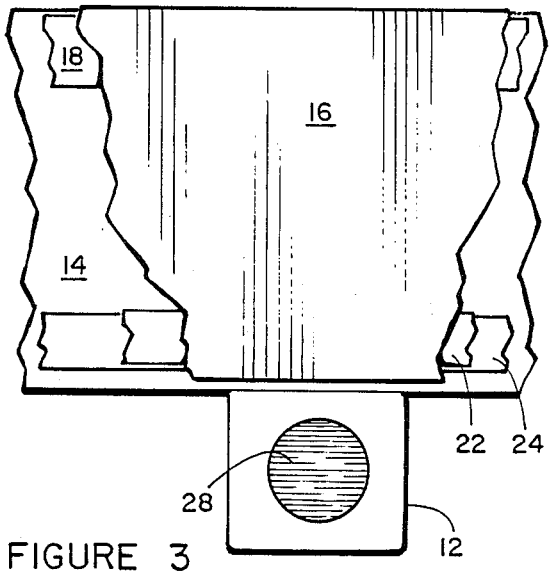
FIG. 3 is a partial top plan view of applicant's novel window alarm system.

Applicant's novel window alarm system will now be described by referring to FIGS. 1–6 of the drawing. The window alarm system is generally designated numeral 10.

Window alarm system 10 has a combination battery and siren alarm assembly housing 12. Housing 12 is rigidly attached to a lower elongated contact strip 14 that is made of a nonelectrically conductive material. Spaced vertically above contact strip 14 is an upper contact strip 16 also formed of nonelectrically conductive material. An elongated spacer 18 connects the two contact strip members 14 and 16 along one of their lateral edges and functions as a hinge member. The other lateral edge of upper contact strip 16 has an elongated upper metal strip attached to its under surface and an elongated lower metal strip is attached to the top surface of lower contact strip 14. Upper metal strip 22 and lower strip 24 function as the terminals of the pressure actuated electrical switch assembly. A plurality of adhesive strips 20 are attached to the underside of member 14 to secure the assembly to the window sill 34 of a window 36 having a glass pane 38.

Figure 6:
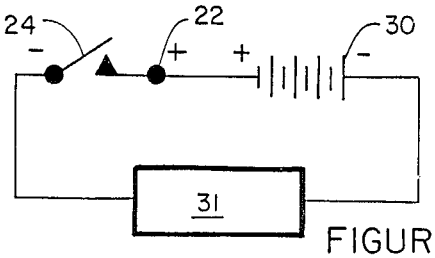
FIG. 6 is an electrical schematic of the electrical circuit of the novel window alarm system.

The siren alarm assembly 26 is formed of a circuit board having the components soldered thereto. Battery 30 and the siren and electrical circuitry 31 are illustrated in FIG. 6. An aperture 28 is formed adjacent the siren alarm assembly 26 and it would be covered by a screen.

Figure 4:
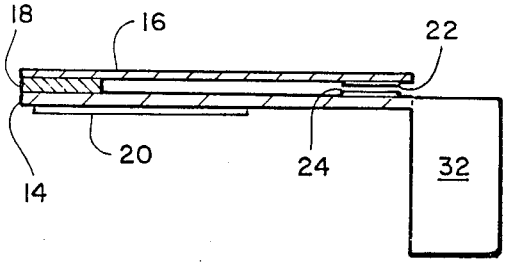
FIG. 4 is a cross sectional view illustrating a first alternative embodiment of applicant's novel window alarm system.
Figure 5:
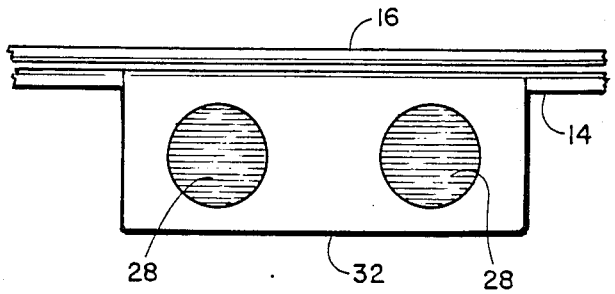
FIG. 5 is a partial front elevational view of the embodiment illustrated in FIG. 4.

A first alternative embodiment is illustrated in FIGS. 4 and 5. A combination battery and siren alarm assembly housing 32 is integrally formed with lower contact strip 14. Housing 32 is illustrated in FIG. 5 as having a pair of apertures in its front wall that are covered with screens to allow the audible signal of the siren alarm assembly to be directed outwardly therefrom.

What is claimed is:

1. A window alarm system comprising:

a source of electrical power having at least one battery;

a pressure actuated electrical switch assembly having first and second terminals;

means electrically connecting said source of electrical power to the first terminal of said switch;

a siren alarm assembly;

means electrically connecting the second terminal of said switch to said siren alarm assembly;

means electrically connecting said siren alarm assembly to said source of electrical power;

said pressure actuated switch assembly comprising an elongated upper contact strip having a top and bottom surface and extending a predetermined length, a flat elongated upper metal strip attached to the bottom surface of said upper contact strip, an elongated lower contact strip having a top and bottom surface and extending a predetermined length, a flat elongated lower metal strip attached to the top surface of said lower contact strip, and spacer means to keep said upper and lower flat metal strips from contacting each other when there is no weight applied to the top surface of said upper contact strip, said upper and lower contact strips have a predetermined width having lateral edges, said spacer means being in the form of an elongated strip of non-conductive material, said strip of non-conductive material extending along adjacent the same lateral edges of said upper and lower contact strips to function as an elongated hinge, said flat elongated metal strips extending along adjacent the other lateral edges of said upper and lower contact strips to function as a normally open pressure actuated electrical switch; and a combination battery and siren alarm assembly housing that is rigidly connected to said lower contact strip.

2. A window alarm system as recited in claim 1 in combination with a window sill wherein the length of said upper and lower contact strips is substantially the width of the window sill itself.

3. A window alarm system comprising:

a source of electrical power having at least one battery;

a pressure actuated electrical switch assembly having first and second terminals;

means electrically connecting said source of electrical power to the first terminal of said switch;

a siren alarm assembly;

means electrically connecting the second terminal of said switch to said siren alarm assembly;

means electrically connecting said siren alarm assembly to said source of electrical power;

said pressure actuated switch assembly comprising an elongated upper contact strip having a top and bottom surface and extending a predetermined length, a flat elongated upper metal strip attached to the bottom surface of said upper contact strip, an elongated lower contact strip having top and bottom surfaces and extending a predetermined length, a flat elongated lower metal strip attached to the top surface of said lower contact strip, and spacer means to keep said upper and lower flat metal strips from contacting each other when there is no weight applied to the top surface of said upper contact strip; and adhesive strip means attached to the bottom surface of said elongated lower contact strip for securing the window alarm system to a window sill.

* * * * *